US009423180B2

(12) United States Patent
Pinches

(10) Patent No.: US 9,423,180 B2
(45) Date of Patent: Aug. 23, 2016

(54) DISC FOR INDUSTRIAL PLANTS

(76) Inventor: David Kenneth Pinches, Victoria (AU)

( * ) Notice: Subject to any disclaimer, the term of this patent is extended or adjusted under 35 U.S.C. 154(b) by 42 days.

(21) Appl. No.: 14/128,236

(22) PCT Filed: Jun. 15, 2012

(86) PCT No.: PCT/AU2012/000687
§ 371 (c)(1),
(2), (4) Date: Dec. 20, 2013

(87) PCT Pub. No.: WO2012/171067
PCT Pub. Date: Dec. 20, 2012

(65) Prior Publication Data

US 2014/0157615 A1 Jun. 12, 2014

(30) Foreign Application Priority Data

Jun. 16, 2011 (NZ) ..... 593495

(51) Int. Cl.

| | |
|---|---|
| ***F26B 25/06*** | (2006.01) |
| ***F26B 25/08*** | (2006.01) |
| ***F26B 23/10*** | (2006.01) |
| ***F26B 17/28*** | (2006.01) |
| ***F28F 5/04*** | (2006.01) |
| *F28F 1/24* | (2006.01) |

(52) U.S. Cl.
CPC ..... *F26B 25/08* (2013.01); *F26B 17/282* (2013.01); *F26B 23/10* (2013.01); *F28F 5/04* (2013.01); *F28F 1/24* (2013.01); *F28F 2215/06* (2013.01); *Y10T 29/49826* (2015.01); *Y10T 428/12354* (2015.01)

(58) Field of Classification Search
CPC ..... F26B 5/00; F26B 11/00; F26B 19/00; F26B 21/00; F26B 25/00; F26B 25/06; F26B 25/08; F28F 1/24; F28F 5/00; F28F 5/04; Y10T 29/49826; Y10T 428/12354
USPC ..... 34/201, 202, 210, 218; 428/595; 29/428
See application file for complete search history.

(56) References Cited

U.S. PATENT DOCUMENTS

| | | | | |
|---|---|---|---|---|
| 2,639,948 A | | 5/1953 | Grimshaw | |
| 3,678,725 A | * | 7/1972 | Langewis | B21D 45/06 72/344 |
| 3,777,814 A | * | 12/1973 | Gustavson | E21B 23/04 166/212 |
| 4,007,967 A | | 2/1977 | Buerger | |
| 4,283,907 A | * | 8/1981 | Pelin | D01H 7/864 57/58.72 |
| 5,598,641 A | * | 2/1997 | Kishi | E03D 5/00 110/238 |

(Continued)

FOREIGN PATENT DOCUMENTS

| | | | | |
|---|---|---|---|---|
| AU | WO 2006007649 A1 | * | 1/2006 | A22C 17/00 |
| AU | WO 2012171067 A1 | * | 12/2012 | F26B 17/282 |

(Continued)

*Primary Examiner* — Stephen M Gravini
(74) *Attorney, Agent, or Firm* — Dann, Dorfman, Herrell and Skillman, P.C.

(57) ABSTRACT

An industrial plant such as a disc dryer is constructed or retro-fitted with discs each comprising two annular plates connected to one another around their outer edges, each plate comprising one or more integral ribs extending between its inner edge and outer edge. The integral ribs may comprise folds in the annular plates, and each plate may be formed from a length of sheet material, by roll forming for example, so that the integral ribs are deeper towards the inner peripheral edge than the outer peripheral edge of the annular plates forming the disc.

12 Claims, 6 Drawing Sheets

Substitute Sheet (Rule 26) RO/AU

(56) References Cited

U.S. PATENT DOCUMENTS 5,621,982 A * 4/1997 Yamashita ..... F26B 21/14 34/203
5,653,044 A * 8/1997 Thom, Jr. ..... F26B 15/14 34/217
5,697,168 A * 12/1997 Matthys ..... F26B 17/20 110/224
5,778,558 A * 7/1998 Wenger ..... F26B 25/10 34/136
5,799,410 A * 9/1998 Gronholz ..... B09B 3/00 34/247
5,860,221 A * 1/1999 Morrison ..... B65D 88/28 34/167
6,085,442 A * 7/2000 Erickson ..... A01J 11/04 34/197
6,088,933 A * 7/2000 Mallalieu ..... F26B 5/08 148/529
6,195,912 B1 * 3/2001 Moon ..... A23N 12/08 34/136
6,920,704 B1 * 7/2005 Silverbrook ..... B41J 11/002 101/483
6,944,970 B2 * 9/2005 Silverbrook ..... F26B 13/102 101/389.1
7,228,645 B2 * 6/2007 Pham ..... H01L 21/67051 118/608
7,347,005 B2 * 3/2008 Cerruti ..... A47L 15/486 134/95.2
7,353,621 B2 * 4/2008 Clarke ..... B04B 3/04 34/138
7,464,485 B2 * 12/2008 Kawase ..... B29B 13/021 34/167
7,603,793 B2 * 10/2009 Hoshino ..... C04B 35/565 264/148
8,161,663 B2 * 4/2012 Weisselberg ..... C10L 9/083 202/109
8,261,466 B2 * 9/2012 Latack ..... D06F 58/04 34/601
8,510,968 B2 * 8/2013 Bunnell ..... F26B 9/06 114/274
8,707,577 B2 * 4/2014 Lee ..... A45D 20/12 132/212
8,720,082 B2 * 5/2014 Kemper ..... A23K 1/001 210/774
8,800,165 B2 * 8/2014 Kwon ..... D06F 25/00 134/18
8,950,081 B2 * 2/2015 Heidecker ..... F26B 5/16 34/381
2011/0223838 A1 * 9/2011 Duescher ..... B24B 37/107 451/28
2011/0319518 A1 * 12/2011 Kadonaga ..... B01F 7/00466 522/86
2013/0029394 A1 * 1/2013 Toll ..... A61L 11/00 435/167

FOREIGN PATENT DOCUMENTS

| | | | | |
|---|---|---|---|---|
| CA | 1040419 | | 10/1978 | |
| CN | 1170863 | | 1/1998 | |
| CN | 101216242 | | 7/2008 | |
| CN | 201306911 | | 9/2009 | |
| CN | 201748779 | | 2/2011 | |
| CN | 201748779 | U * | 2/2011 | |
| DE | 3838640 | | 6/1990 | |
| DE | 10246639 | | 4/2004 | |
| GB | 216165 | | 8/1925 | |
| GB | 902186 | | 7/1962 | |
| GB | 1320841 | A * | 6/1973 | ..... F04D 13/0646 |
| JP | 2009045525 | | 3/2009 | |
| KR | 100987573 | | 10/2010 | |

* cited by examiner

DISC FOR INDUSTRIAL PLANTS

FIELD OF THE INVENTION

The invention generally relates to discs for use in industrial applications such as dryers, cookers, coolers or other heat exchangers and particularly, although not exclusively, relates to a disc dryer.

BACKGROUND TO THE INVENTION

Disc dryers are large industrial dryers used for drying conveyable or flowable materials such as granular and liquid type products. They typically comprise a hollow shaft carrying hollow annular discs at intervals. Each disc comprises a pair of annular plates welded around the periphery to the shaft. The shaft is formed to have apertures through its wall to the hollow interior of each disc. In operation of the dryer steam is fed through the shaft and passes through the apertures into the hollow region formed by the discs heating the surface of the discs. Material to be dried moves through an inlet formed through an outer casing of the disc dryer and along the length of the shaft where it contacts the outer surfaces of the heated discs thereby drying the material.

As shown in FIG. 5, the discs 41 in a conventional disc dryer 40 have flat surfaces and can be fitted with cross pins 43 that span between the two annular plates 42 forming each disc to prevent the discs from deforming or bursting under steam pressure. At construction of the disc dryer or retrofitting of replacement discs, fitting cross pins to each disc requires drilling or cutting holes through the disc and pressing in and welding of many individual cross pins. This is labour intensive and is carried out when constructing a new disc dryer or retro-fitting an existing dryer with new discs when the existing discs have worn. Other methods for strengthening the discs other than fitting cross-pins are also known in the art but these are also generally labour intensive.

The annular plates for forming discs for disc dryers are typically formed by cutting one or more circular sheets from a square sheet of metal leading to significant scrap metal.

It is an object of the invention to provide an improved disc for use in industrial applications and/or improved disc dryer, or to at least provide the public with a useful choice.

SUMMARY OF THE INVENTION

In a first aspect the invention broadly consists in a disc comprising two annular plates connected to one another at an angle around corresponding outer peripheral edges such that corresponding inner peripheral edges of the plates are spaced apart from one another, each plate comprising one or more integral ribs extending between its inner edge and outer edge.

In a second aspect the invention broadly consists in an industrial plant comprising:

- a hollow shaft;
- one or more hollow discs each comprising two annular plates connected to one another around their outer edges, each plate comprising one or more integral ribs extending between its inner edge and outer edge, the inner edge of each plate being coupled around the shaft and spaced apart from one another so that the disc is coupled to the shaft; and
- one or more apertures along the length of the shaft provided between the plates of each disc so that the shaft is in fluid communication with each disc.

Preferably, the ribs are formed from folds in the annular plate.

Preferably in a first form, the ribs extend radially between the inner edge of the plate and the outer edge of the plate.

Preferably, each plate is formed from a length of a sheet of material. More preferably, the sheet of material is formed to integrally comprise the ribs. Even more preferably in a first form, the ribs are formed by rolling and are deeper towards one edge of the sheet of material than the other edge of the sheet of material such that the material curves greater around the deeper ends of the ribs in order to form an annular plate. Even more preferably in a second form, the ribs are formed by crimping or folding.

In a third aspect the invention broadly consists in a method of fitting a disc to an industrial plant comprising:

- passing a hollow disc along a hollow shaft so that the interior of the disc is proximal to an aperture provided on the shaft, the disc comprising two annular plates connected to one another around their periphery edges, each plate comprising one or more integral ribs extending between its inner edge and periphery edge;
- connecting the inner edge of the first annular plate to the shaft; and
- connecting the inner edge of the second annular plate to the shaft and spaced apart from the inner edge of the first annular plate such that the aperture is provided between the inner edges of the annular plates so that the shaft is in fluid communication with the disc.

Preferably, each plate is formed from a length of a sheet of material. More preferably, the sheet of material is formed to integrally comprise the ribs. Even more preferably in a first form, the ribs are formed by rolling and are deeper towards one edge of the sheet of material than the other edge of the sheet of material such that the material curves greater around the deeper ends of the ribs in order to form an annular plate. Even more preferably in a second form, the ribs are formed by crimping or folding.

In an fourth aspect the invention broadly consists in a method of constructing an industrial plant comprising:

- for each of one or more hollow discs, passing the discs along a hollow shaft so that the interior of the disc is proximal to an associated aperture provided on the shaft, the disc comprising two annular plates connected to one another around their periphery edges, each plate comprising one or more integral ribs extending between its inner edge and periphery edge;
- connecting the inner edge of the first annular plate to the shaft; and
- connecting the inner edge of the second annular plate to the shaft and spaced apart from the inner edge of the first annular plate such that the aperture is provided between the inner edges of the annular plates so that the shaft is in fluid communication with the disc.

In one form of the second, third and fourth aspects the industrial plant is a disc dryer, cooker, cooler or a heat exchanger.

Preferably the industrial plant is a disc dryer.

In a fifth aspect the invention broadly consists in a method of forming a disc for use in an industrial application comprising connecting the outer periphery edges of two annular plates to one another at an angle around their outer edges such that the inner edges of the plates are spaced apart from one another, each plate comprising one or more integral ribs extending between its inner edge and periphery edge.

In a sixth aspect the invention broadly consists in a method of forming an annular plate for use in construction of a disc for an industrial application comprising:

- rolling one or more ribs into a flat length of a sheet of material, the ribs being deeper at one edge of the material than the other edge of the material such that the material curves greater around the deeper ends of the ribs in order to form an annular plate; and joining the two ends of the sheet of material.

Preferably in the fifth and sixth aspects the industrial application is an industrial plant. Preferably the industrial plant is a disc dryer.

In a seventh aspect the invention broadly consists in a disc for a disc dryer comprising two annular plates connected to one another at an angle around their outer edges such that the inner edges of the plates are spaced apart from one another, each plate comprising one or more integral ribs extending between its inner edge and outer edge.

In an eighth aspect the invention broadly consists in a disc dryer comprising:

a hollow shaft;

one or more hollow discs each comprising two annular plates connected to one another around their outer edges, each plate comprising one or more integral ribs extending between its inner edge and outer edge, the inner edge of each plate being coupled around the shaft and spaced apart from one another so that the disc is coupled to the shaft; and one or more apertures along the length of the shaft provided between the plates of each disc so that the shaft is in fluid communication with each disc.

The first, fourth, fifth, sixth, seventh and eighth aspects of the invention may include any of the preferable features associated with the second or third aspects of the invention.

Preferably for all of the above aspects of the invention, each plate has a central aperture with a radius between 0.2 and 0.5 m.

Preferably the radius of each plate is between 0.4 and 1.5 m.

Preferably the thickness of each annular plate is between 6 and 12 mm.

The term "comprising" as used in this specification means "consisting at least in part of." When interpreting each statement in this specification that includes the term "comprising", features other than that or those prefaced by the term may also be present. Related terms such as "comprise" and "comprises" are to be interpreted in the same manner.

The term "annular" as used in this specification in relation to the discs and plates includes same with a circular outer peripheral shape but also a non-circular outer peripheral shape such as an oval or square or rectangular outer peripheral shape (typically with radiused corners).

BRIEF DESCRIPTION OF THE DRAWING

Preferred embodiments of the invention will be described by way of example only and with reference to the drawings, in which.

DETAILED DESCRIPTION OF PREFERRED EMBODIMENTS

The invention relates to a disc formed from annular plates having one or more integral ribs extending between an inner edge of the plate and an outer edge of the plate. The disc of the invention may be formed for use in a number of industrial applications including, but not limited to industrial plants such as disc dryers, cookers, coolers and other heat exchangers, and also paddle dryers. Such plants typically comprise a hollow shaft on which one or more of the discs of the invention are mounted about. A heating or cooling fluid source is introduced into the main shaft to heat or cool the surfaces of the discs respectively. Material, gas or fluid flowing through the plant (preferably external to but may be within the shaft) is appropriately heated or cooled by the discs before exiting the plant. In accordance with an aspect of the invention, the disc of the invention will be described in detail with reference to a disc dryer. It will be appreciated however that the disc may be used in any industrial application as mentioned.

Figure 1:
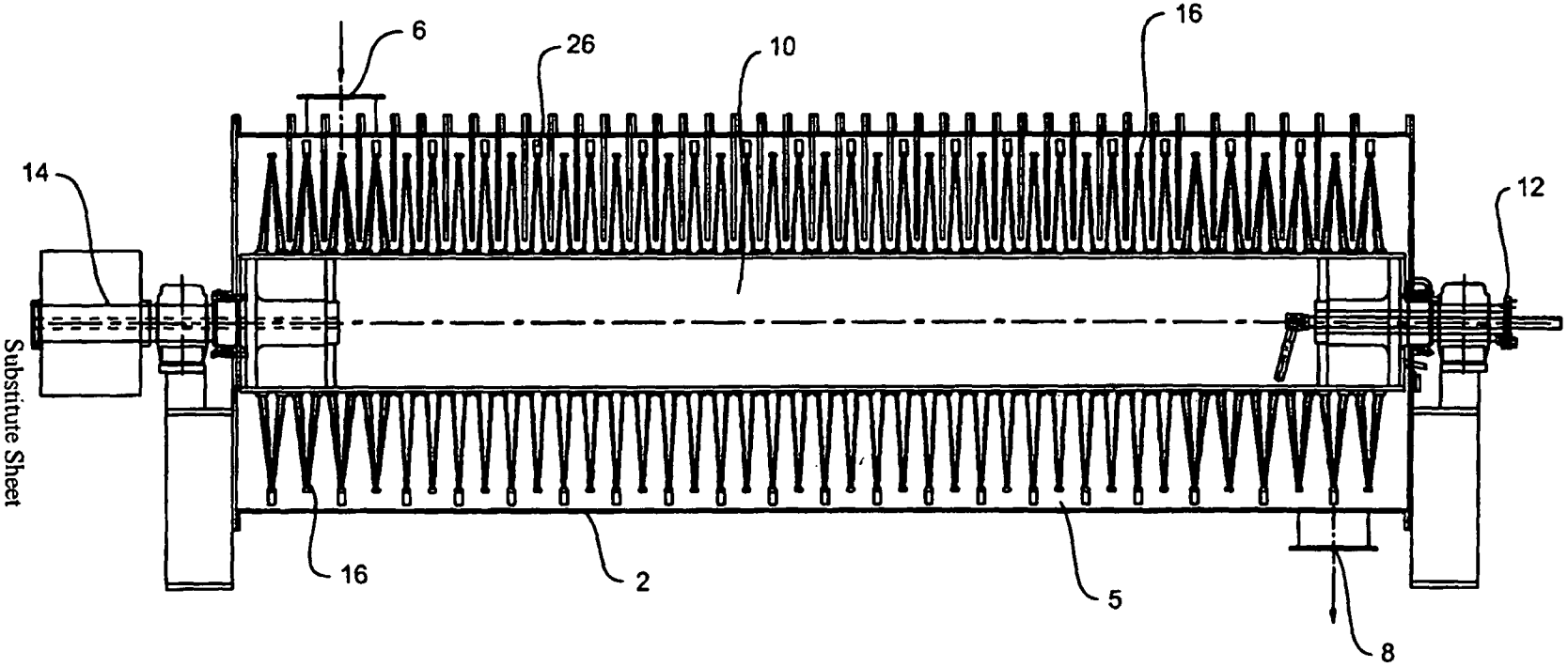
FIG. 1 is a cut-away, elevation view of a disc dryer of the invention.

Referring to FIG. 1 and by way of example, a disc dryer 2 comprises a casing 4 arranged to hold a material 5 to be dried. The casing 4 may be made from a metal or alloy such as aluminium or steel, or any other suitable material. The material may be a pasty material, a sludge-like material, a particulate material, or any other suitable material that can flow through the casing 4 in order to be dried such as food material, grain or meal, coffee beans, chemicals, gluten, or waste-water sludge. The disc dryer 2 may comprise an inlet 6 so that the wet material 5 can enter the casing 4 in order to be dried, and an outlet 8 for removal of dried material 5. Alternatively, the casing may be provided with a lid or hatch through which material 5 may be introduced into and removed from the disc dryer 2.

The disc dryer comprises a drum, rotor, or shaft 10 extending through the casing 4. The shaft 10 may be arranged to rotate within the casing 4 for example through actuation from an electric motor coupled to one end. The shaft 10 is hollow so that a heating fluid may flow through the shaft. The shaft 10 may comprise a first connector 12 at one end arranged to be coupled to a heating fluid source, and a second connector 14 at the other end arranged to be coupled to a heating fluid sink. Heating fluid may be may be introduced into the shaft 10 through the first connector 12 so that the heating fluid transfers heat to the shaft 10 which then transfers heat to the material 5. Preferably, the heating fluid is pressurised steam, however any other suitable heating fluid may be used such as a heated liquid that is pumped into the shaft. The heating fluid may travel the length of the shaft 10, transferring heat to it on the way, and then be removed at the second connector 14. The shaft 10 may be constantly replenished with heating fluid from a heating fluid source so that the shaft 10 may constantly provide heat to the material 5. In applications other than dryers such as in a cooler or heat exchanger the fluid may be a cooling fluid or a fluid which receives heat from the material passing through the plant.

The shaft 10 comprises one or more discs 16 provided along its length. The discs 16 are connected to the shaft 10 so that they may rotate with the shaft 10. For example, the discs 16 may be welded to the shaft 10 or connected to the shaft 10 in any other suitable manner. The shaft 10 and discs 16 may be made from a material with a high thermal conductivity such as a metal or alloy, or any other suitable material. Referring now also to FIG. 1*a*, the discs 16 are hollow. One or more apertures 17 are provided along the length of the shaft 10 so that the inside 10*a* of the shaft 10 is in fluid communication with the inside 16*a* of each disc 16 as shown by arrow A of FIG. 1*a*. The apertures 17 are provided so that the heating fluid can move from the shaft 10 to the discs 16 in order to heat the discs 16 and to provide a greater heating area to the material 5. Each disc coupled around the shaft may be able withstand internal pressure of for example 2-3 Bar, or in some embodiments higher such as up to or over 6 Bar and for example up to 12 Bar without substantially deforming. A heat exchanger may operate at about atmospheric pressure, a cooler at the same or at 2-3 bar for example, and a disc dryer at an internal (steam) pressure of 6 Bar or over, up to 10-12 Bar for example. Preferably, the shaft 10 and discs 16 are closed to the material so that the heating fluid cannot contact the material 5 directly. The material 5 may be heated or dried through contact with the outside surfaces of the shaft 10 and discs 16.

Figure 2:
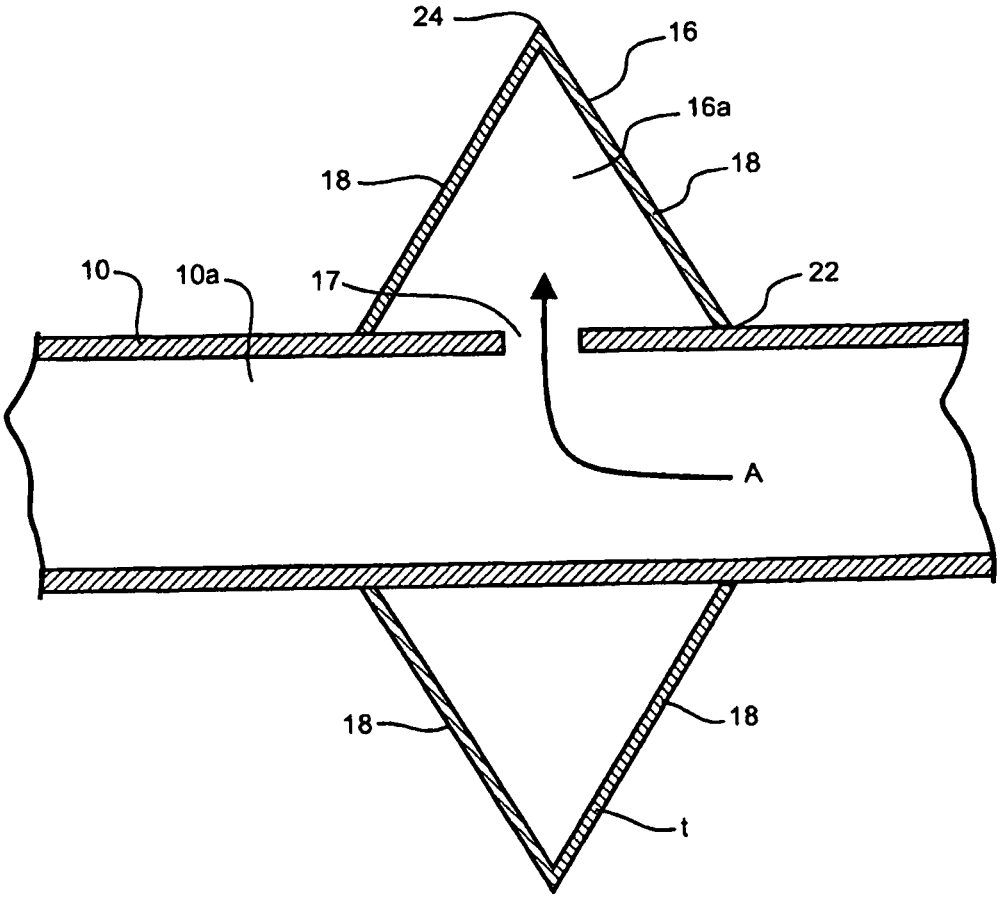
FIG. 2 is a cross-sectional close up view of a single disc element coupled to the shaft of the dryer of FIG. 1.
Figure 3:
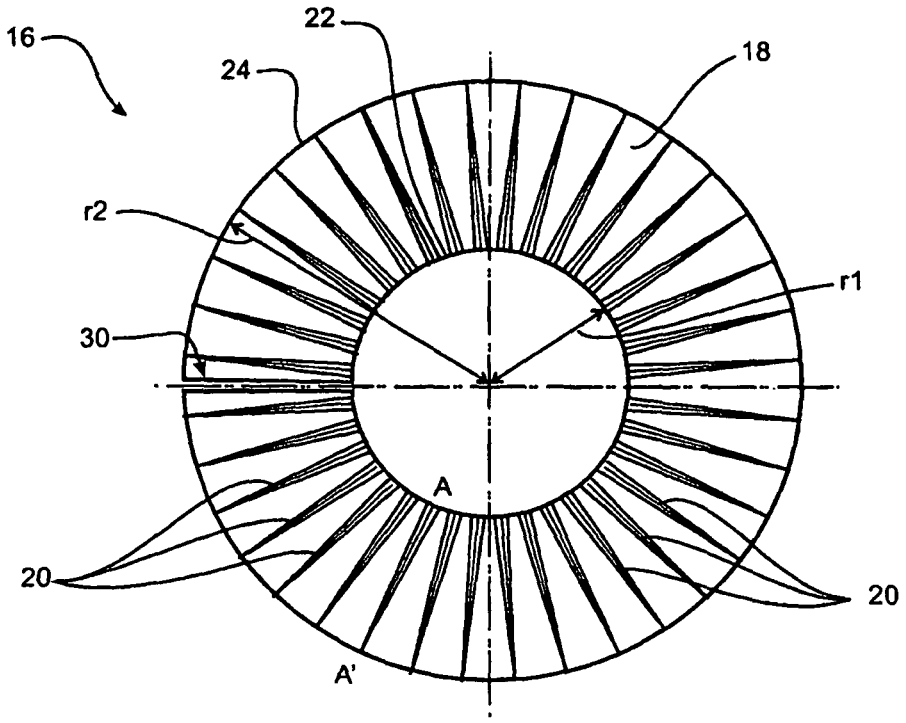
FIG. 3 is a plan view of an annular plate used to form a disc of the disc dryer of FIG. 1.

Referring to FIGS. 1, 2, and 3 the discs 16 are formed from two or more annular plates 18. Each plate 18 comprises one or more integral ribs 20 on its surface. Preferably, the ribs 20 extend between the inner edge 22 of the annular plate 18 and the outer edge 24 of the annular plate 18. The ribs 20 may extend radially between corresponding points AA' on the inner edge 22 and the outer edge 24. The ribs 20 may extend fully or partially between the inner edge 22 and outer edge 24. Alternatively, the integral ribs 20 may be provided between and substantially follow the circumferences of the edges 22, 24 or at any other orientation but most preferably radially between the inner 22 and outer edge 24 to provide maximum strength. The integral ribs 20 may be provided on the plates 18 in any suitable manner. Preferably, the integral ribs 20 are formed from crimps, bends, creases, stamps, or folds in the plates 18. However, the integral ribs 20 may be formed from metal strips or bars that are connected to the plates 18, or in any other suitable manner. The integral ribs 20 may provide structural strength or support to the plates 18 and discs 16. This may help prevent the discs 16 from deforming or bursting under pressure when in use. This may also mean that a lesser number of plugs, or no plugs, may be required to provide strength to hold the discs 16 together when a pressurised heating fluid is introduced to the disc dryer 2.

A disc 16 may be formed by connecting two plates 18 to one another around their outer edges 24. The outer edges 24 may be welded to one another, or connected to one another in any suitable manner. The outer edges 24 of the plates 18 are connected to one another at an angle around their entire circumference such that the inner edges 22 of the two plates 18 are spaced apart from one another when the connection is complete. Preferably, the angle is an acute angle. A disc 16 may then be connected to the shaft 10 by connecting each of the inner edges 22 to the shaft 10, with the inner edges 22 spaced apart from one another. The inner edges 22 may be welded to the shaft 10, or connected to the shaft 10 in any suitable manner. When a disc 16 is connected to the shaft 10, the disc 16 may appear convex when viewed from the side (as shown in FIG. 1) due to the angle provided between the outer edges 24 of the two plates 18 and the inner edges 22 being spaced apart from one another. At least one aperture in the shaft 10 is provided between the two inner edges 22 of a disc 16 so that the shaft 10 is in fluid communication with a disc 16 and so that a heating fluid can move between them.

Referring to FIG. 1, each disc 16 may have one or more shovels 26 connected to a side or periphery of the disc 16. The shovels 26 may rotate with the shaft 10 and discs 16. The shovels 26 may move, scoop or push the material 5 within the disc dryer 2 and towards the output 8 in order to dry the material 5. Alternatively, the discs 16 may be connected to the shaft 10 at a non-right angle so that a screwing effect from the rotating discs 16 encourages movement of the material 5.

Figure 4:
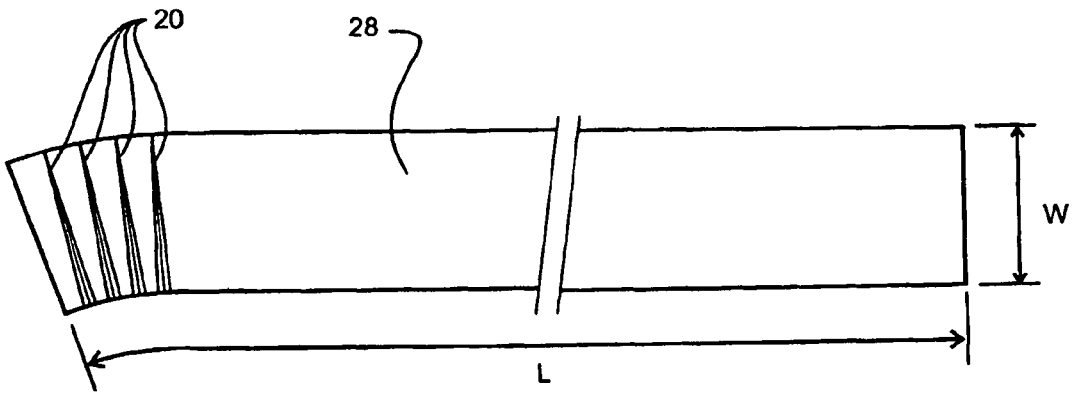
FIG. 4 is a plan view of a partially formed annular plate of FIG. 3.
Figure 5:
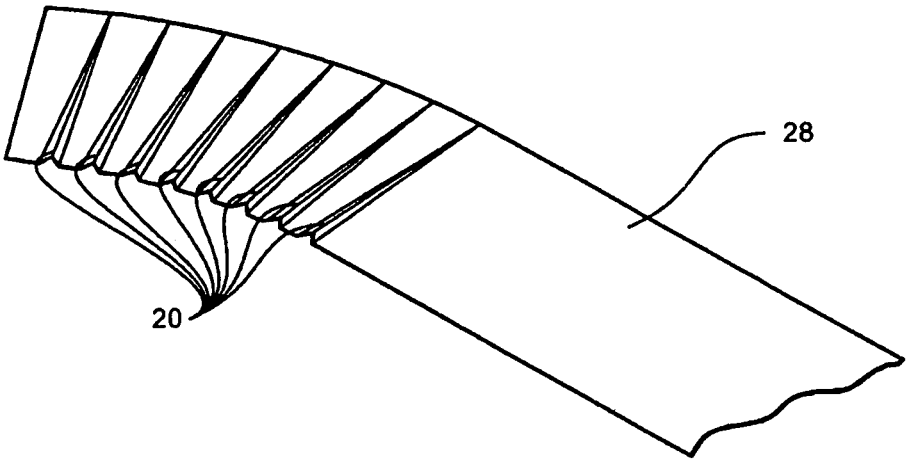
FIG. 5 is a perspective view of a partially formed annular plate of FIG. 3.

Referring to FIGS. 4 and 5, in the preferred embodiment, each plate 18 may be formed from a length of a sheet of a suitable material 28 such as steel or any other suitable material. Preferably, the sheet of material 28 has a longer length L than width W. For example, the sheet of material 28 may be 6120 mm long and 550 mm wide. A plate 18 may be formed by rolling the sheet of material 28 in a roll forming mill. The integral ribs 20 may be rolled into the sheet of material 28 as it is passed through the roll forming mill. Each integral rib 20 may be relatively deeper at one long edge (becomes the inner edge 22 of the resultant annular plate 18) of the material than the other long edge (becomes the outer edge 24 of the resultant annular plate 18) of the material. This may cause the sheet of material 28 to curve greater around the deeper ends of the ribs 20 so that it is formed into an annular shape once it has been entirely passed through the rolling mill. The two ends of the sheet of material 28 may be connected to one another at a joint 30 (shown in FIG. 3) in order to form the completed plate 18. The two ends may be welded to one another or connected to one another in any other suitable manner. This forms an annular plate 18 having a central aperture (defined by the inner edge 22) of sufficient size to fix around the shaft of the disc dryer.

The sheet material 28 and in particular the resultant plate 18 should have sufficient dimension for use in industrial applications. In the case of disc dryers, preferably the resultant plate 18 has an inner edge/central aperture radius r1 (shown in FIG. 3) of at least 0.2 m but more preferably between 0.2 and 0.5 meters, an outer edge radius r2 (shown in FIG. 2) of at least 0.4 m but more preferably between 0.4 and 1.5 meters, and a thickness t (shown in FIG. 1*a*) of at least 6 millimetres but more preferably between 6 and 12 mm. It will be appreciated that other dimensions for the resultant plate or disc may be utilised in disc dryers or other industrial applications and the above dimensions are only exemplary and not intended to limit the scope of the invention.

In an alternative embodiment, the plates 18 may be formed from an annular shape cut from a flat sheet of material. The annulus of material may have one or more ribs 20 folded, crimped or punched into its surface in order to form a plate 18 such that the ribs 20 are integral with the plate 18.

The discs 16 and plates 18 may be of shapes other than circular, such as oval or square or rectangular in shape (typically with radiused corners), all of which are included within the term 'annular' in this specification and claims. Also, the shaft 10 may have a rectangular cross-section and the plates 18 and discs 16 having corresponding rectangular apertures for fitting the discs 16 around the shaft.

Figure 6:
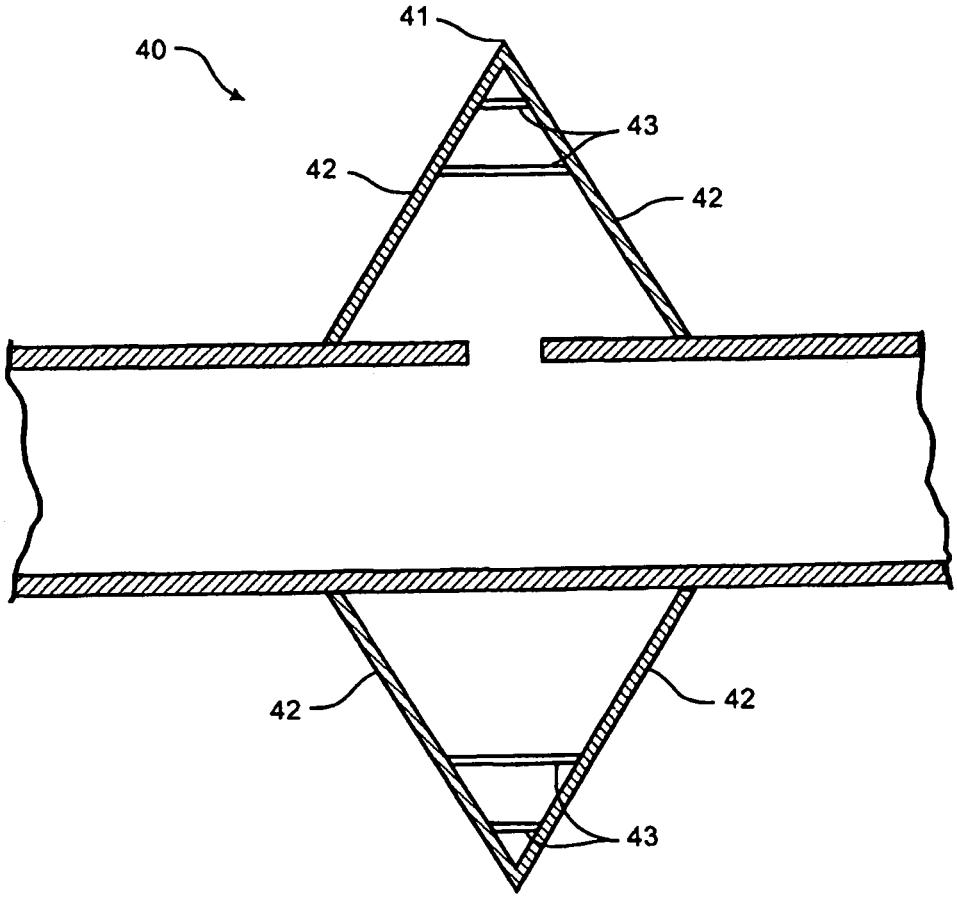
FIGURE 6 (Prior Art)
FIG. 6 is a cross-sectional close up view of a disc in a conventional disc dryer.

As referred to previously the discs in a conventional disc dryer or similar have flat surfaces and are fitted with cross pins that span between the two annular plates forming each disc to prevent the discs from deforming or bursting under steam pressure, as shown in FIG. 6. At construction of the disc dryer or retrofitting of replacement discs, fitting cross pins to each disc requires drilling or cutting holes through the disc and pressing in and welding of many individual cross pins which is labour intensive and is carried out when constructing a new disc dryer or retro-fitting an existing dryer with new discs when the existing discs have worn. The need for fitting or replacing such cross pins is removed or at least reduced wuth the construction of the invention.

The foregoing description of the invention includes preferred forms thereof. Modifications may be made thereto without departing from the scope of the invention.

The invention claimed is:

1. An industrial plant comprising:

a shaft having a hollow interior;

at least one hollow disc coupled to the shaft, the hollow disc comprising two annular plates continuously connected to one another around outer edges of the annular plates, the hollow disc comprising interior space between the two annular plates closed to the exterior of the disc at the continuously connected outer edges of the annular plates, each annular plate comprising integral ribs extending substantially radially between an inner edge and the outer edge of the annular plate, spaced around the annular plate, and formed from folds in the annular plate, the inner edge of the two annular plates being coupled around the shaft and spaced apart from one another; and at least one aperture in the shaft between the plates of the disc so that the hollow interior of the shaft is in fluid communication with an interior space between the two annular plates of the disc.

2. An industrial plant according to claim 1 wherein each plate is formed from a length of sheet material.

3. An industrial plant according to claim 2 wherein the integral ribs are deeper towards the inner edge than the outer edge of each annular plate, the ribs having deeper ends at or near the outer edge of the annular plate and the length of sheet material curves around the deeper ends of the ribs to form the annular plate.

4. An industrial plant according to claim 3 wherein the integral ribs have been formed by roll forming the length of sheet material.

5. An industrial plant according to claim 3 wherein the integral ribs have been formed by crimping, punching, or folding the length of a sheet of material.

6. An industrial plant according to claim 1 wherein each plate has a central aperture with a radius between 0.2 and 0.5 m.

7. An industrial plant according to claim 1 wherein each plate has a central aperture with a radius 0.4 and 1.5 m.

8. An industrial plant according to claim 3 wherein each plate has a thickness between 6 and 12 mm.

9. An industrial plant according to claim 1 wherein the disc can withstand internal pressure of at least 6 Bar without substantially deforming.

10. An industrial plant according to claim 1 wherein the industrial plant is a disc dryer.

11. An industrial plant according to claim 1 comprising:

multiple hollow discs coupled to the shaft and spaced a long a length of the shaft, each hollow disc comprising two annular plates continuously connected to one another around outer edges of the annular plates, the hollow disc comprising interior space between the two annular plates closed to the exterior of the disc at the continuously connected outer edges of the annular plates, each annular plate comprising integral ribs extending substantially radially between an inner edge and the outer edge of the annular plate, spaced around the annular plate, and formed from folds in the annular plate, the inner edge of the two annular plates being coupled around the shaft and spaced apart from one another; and at least one aperture in the shaft between the plates of each disc so that the hollow interior of the shaft is in fluid communication with an interior space between the two annular plates of the disc.

12. An industrial disc dryer comprising multiple hollow dryer discs around and spaced a long a length of a shaft, each hollow disc comprising two annular plates continuously connected to one another around outer edges of the annular plates, the hollow disc comprising interior space between the two annular plates closed to the exterior of the disc at the continuously connected outer edges of the annular plates, each annular plate formed from sheet material and comprising integral ribs extending substantially radially between an inner edge and the outer edge of the annular plate, spaced around the annular plate, and formed from folds in the annular plate, the integral ribs being deeper towards the inner edge than the outer edge of each annular plate, the inner edge of the two annular plates being coupled around the shaft and spaced apart from one another.

* * * * *